US006563407B2

(12) United States Patent
Kramer

(10) Patent No.: US 6,563,407 B2
(45) Date of Patent: May 13, 2003

(54) PIVOT JOINT FOR A MOVABLE CONTACT ARM IN A MOLDED CASE CIRCUIT BREAKER

(75) Inventor: Rodney C. Kramer, Snellville, GA (US)

(73) Assignee: Siemens Energy & Automation, Inc., Alpharetta, GA (US)

( * ) Notice: Subject to any disclaimer, the term of this patent is extended or adjusted under 35 U.S.C. 154(b) by 0 days.

(21) Appl. No.: 09/934,412

(22) Filed: Aug. 21, 2001

(65) Prior Publication Data

US 2003/0038695 A1 Feb. 27, 2003

(51) Int. Cl.[7] ..... H01H 75/00
(52) U.S. Cl. ..... 335/16; 335/172; 200/244
(58) Field of Search ..... 335/16, 147, 195, 335/166–176, 200; 200/244, 272–273

(56) References Cited

U.S. PATENT DOCUMENTS

| | | | | |
|---|---|---|---|---|
| 4,245,203 A | * | 1/1981 | Wafer et al. | 200/244 |
| 4,594,567 A | | 6/1986 | DiMarco et al. | 335/16 |
| 4,931,603 A | * | 6/1990 | Castonguay et al. | 335/16 |
| 5,146,194 A | * | 9/1992 | Altenhof, Jr. et al. | 335/16 |
| 5,270,564 A | | 12/1993 | Parks et al. | 200/401 |
| 5,343,174 A | | 8/1994 | Turner et al. | 335/172 |
| 5,394,126 A | | 2/1995 | Grunert et al. | 335/42 |
| 5,517,164 A | | 5/1996 | Zoller et al. | 335/16 |
| 5,534,835 A | | 7/1996 | McColloch et al. | 335/172 |

* cited by examiner

*Primary Examiner*—Lincoln Donovan
(74) *Attorney, Agent, or Firm*—Foley & Lardner

(57) ABSTRACT

A pivot joint for a movable contact arm assembly and a circuit breaker having an operating mechanism coupled to a line terminal, a trip mechanism and a load terminal with the load terminal coupled to a pivot mounting member. The pivot joint comprises a recess in a first sidewall of the contact arm with the recess co-axial with a mounting hole in the contact arm. A second recess is provided in a second sidewall of the contact arm with the second recess co-axial with the second mounting hole in the contact arm. The first and second recesses are co-axial with each other. A shaped washer, configured to fit in each of the first and second recesses is provided and maintained in position by a mounting axle configured to engage each shaped washer, each mounting hole and the pivot mounting member. The contact arm is then free to pivot about the mounting axle. A spring, with the spring configured to engage both ends of the mounting axle urge the contact arm against each shaped washer thereby completing the pivot joint. The two recesses formed in the contact arm can be in a facing relationship with each other and the shaped washers can be spherical.

20 Claims, 4 Drawing Sheets

PIVOT JOINT FOR A MOVABLE CONTACT ARM IN A MOLDED CASE CIRCUIT BREAKER

BACKGROUND OF THE INVENTION

The present invention relates generally to the field of circuit breakers, and more particularly to a pivot joint for a movable contact arm in a molded case circuit breaker.

In general the function of a circuit breaker is to electrically engage and disengage a selected circuit from an electrical power supply. This function occurs by engaging and disengaging a pair of operating contacts for each phase of the circuit breaker. The circuit breaker provides protection against persistent overcurrent conditions and against the very high currents produced by short circuits. Typically, one of each pair of the operating contacts are supported by a pivoting contact arm while the other operating contact is substantially stationary. The contact arm is pivoted by an operating mechanism such that the movable contact supported by the contact arm can be engaged and disengaged from the stationary contact.

There are two modes by which the operating mechanism for the circuit breaker can disengage the operating contacts: the circuit breaker operating handle can be used to activate the operating mechanism; or a tripping mechanism, responsive to unacceptable levels of current carried by the circuit breaker, can be used to activate the operating mechanism. For many circuit breakers, the operating handle is coupled to the operating mechanism such that when the tripping mechanism activates the operating mechanism to separate the contacts, the operating handle moves to a fault or tripped position.

To engage the operating contacts of the circuit breaker, the circuit breaker operating handle is used to activate the operating mechanism such that the movable contact(s) engage the stationary contact(s). A motor coupled to the circuit breaker operating handle can also be used to engage or disengage the operating contacts. The motor can be remotely operated.

A typical industrial circuit breaker will have a continuous current rating ranging from as low as 15 amps to as high as several thousand amps. The tripping mechanism for the breaker usually consists of a thermal overload release and a magnetic short circuit release. The thermal overload release operates by means of a bi-metalic element, in which current flowing through the conducting path of a circuit breaker generates heat in the bi-metal element, which causes the bi-metal to deflect and trip the breaker. The heat generated in the bi-metal is a function of the amount of current flowing through the bi-metal as well as the period of time that that current is flowing. For a given range of current ratings, the bi-metal cross section and related elements are specifically selected for such current range resulting in a number of different current ranges for each circuit breaker. Some circuit breakers, industrial for example, provide for an indirectly heated bi-metal element. Electronic trip units are also used in some applications.

In the event of current levels above the normal operating level of the thermal overload release, it is desirable to trip the breaker without any intentional delay, as in the case of a short circuit in the protected circuit, therefore, an electromagnetic trip element is generally used. In a short circuit condition, the higher amount of current flowing through the circuit breaker activates a magnetic release which trips the breaker in a much faster time than occurs with the bi-metal heating. It is desirable to tune the magnetic trip elements so that the magnetic trip unit trips at lower short circuit currents at a lower continuous current rating and trips at a higher short circuit current at a higher continuous current rating. This matches the current tripping performance of the breaker with the typical equipment present downstream of the breaker on the load side of the circuit breaker. Again, electronic trip units can also be used. Because of the higher voltages and currents that must be interrupted, there is potential for damage to the components of a circuit breaker from the hot by-products of the electric arc interruption. During an electrical interruption, both gasses and small molten metallic particles are generated and expand outward from the electrical contacts into the arc chamber area of the circuit breaker and the contact arm heats up.

Another problem occurs in circuit breakers subject to high continuous current ratings. In a circuit breaker that is subject to high current, the overall size of the breaker must be larger in order to accommodate conductors with a larger cross section. This means that the crossbar must be longer. In addition, because greater pressure is required to maintain the contacts, the movable contact and the stationary contact, in a closed position a greater force is transmitted to the crossbar. Because of the longer length and the greater forces on the crossbar, the crossbar has a tendency to flex or bow along its length when the circuit breaker is "ON" and the contacts are closed. In such situations, the crossbar flexes but the contact arm pivot remains stationary. As a result, the geometric relationship between the surfaces of the crossbar and the contact arm change which changes the amount of torque applied to the contact arm by the crossbar during normal operation or in an overload condition. Therefore, flexing of the crossbar can cause an unacceptable amount of variation in the pressure that must be applied to the contact arms and the dimensions of the contact arm assembly needed to maintain the proper mechanical and electrical coupling with the contacts.

Thus, there is a need for a molded case circuit breaker that will minimize or eliminate the effects of geometric and dimensional changes between the crossbar and the contact arm pivot. There is an additional need to overcome the physical misalignment of the contact arm to the stationary pivot caused by various factors, not the least of which is misalighed elements of the arm assembly due to manufacturing tolerances. There is also a need to prevent misalignment in the final contact arms of a circuit breaker closed. There is a further need for a molded case circuit breaker that can be easily reconfigured over a broad range of current ratings by utilizing interchangeable parts and additional parts with a minimum of unique parts.

SUMMARY OF THE INVENTION

The present invention provides a pivot joint for a movable contact arm assembly in a circuit breaker having an operating mechanism coupled to a line terminal, a trip mechanism and a load terminal with the load terminal coupled to a pivot mounting member. The pivot joint comprises a recess in a first sidewall of the contact arm with the recess co-axial with a mounting hole in the contact arm. A second recess is provided in a second sidewall of the contact arm with the second recess co-axial with the second mounting hole in the contact arm. The first and second recesses are co-axial with each other. A shaped washer, configured to fit in each of the first and second recesses, is provided and maintained in position by a mounting axle configured to engage each shaped washer, each mounting hole and the pivot mounting member. The contact arm is then free to pivot about the mounting axle. A spring, with the spring configured to engage both ends of the mounting axle, urges the contact arms against each shaped washer thereby completing the pivot joint. The two recesses formed in the contact arm can be in a facing relationship with each other and the shaped washers can be spherical.

The present invention also provides a molded case circuit breaker comprising a molded housing including a breaker cover, a first terminal and a second terminal mounted in the housing and a contact electrically coupled to the first terminal. An operating mechanism having a pivoting member movable between an "ON" position, an "OFF" position and a "TRIPPED" position is also mounted in the housing. An intermediate latching mechanism is mounted in the housing and coupled to the operating mechanism. A trip mechanism is selectively coupled to the operating mechanism and electrically connected to the second terminal. A moving contact arm and assembly including a pivot mounting member is coupled to the second terminal and the pivot member of the operating mechanism. A pivot joint for the moving contact arm comprises a recess in a first sidewall of the contact arm with the recess co-axial with the mounting hole in the contact arm. A second recess is provided in a second sidewall of the contact arm with the second recess co-axial with the second mounting hole in the contact arm, wherein the first and second recesses are co-axial with each other. A shaped washer, configured to fit in each of the first and second recesses are inserted in each recess. A mounting axle configured to engage each shaped washer, mounting hole and pivot mounting member is inserted in the mounting holes. The contact arm is then free to pivot about the mounting axle with a spring configured to engage both ends of the mounting axle and urging the contact arm against each shaped washer.

The present invention also provides a circuit breaker comprising a housing including a base, a means for connecting a load to the breaker mounted in the housing together with the means for connecting an electrical line to the breaker also mounted in the housing. The stationary contact is electrically coupled to the means for connecting the electrical line. A means for moving a contact arm coupled to a means for operating is mounted in the housing and having a pivoting member movable between an "ON" position, an "OFF" position and a "TRIPPED" position. The pivoting member is coupled to the means for moving a contact arm and with the means for operating coupled to the intermediate means for latching the means for operating. A means for tripping is coupled to the means for moving a contact arm and the means for connecting the load with the means for tripping in selective operative contact with the intermediate means for latching and the means for connecting a load is coupled to a means for mounting the contact arm. A means for pivoting the contact arm couples the contact arm with the means for mounting the contact arm. The pivot comprises a means for recessing in a first sidewall of the contact arm with the means for recessing co-axial with the mounting hole in the contact arm. A second means for recessing in a second sidewall of the contact arm is provided. The second means for recessing is co-axial with a second mounting hole in the contact arm wherein the first and second means for recessing are co-axial with each other. A means for reducing binding is configured to fit in each of the first and second means for recessing. A mounting axle configured to engage each means for reducing binding, each mounting hole and the means for mounting the contact arm is installed in the mounting holes wherein the contact arm is free to pivot about the mounting axle. A means for biasing, with the means for biasing configured to engage both ends of the mounting axle and urge the contact arm against the means for reducing binding, is installed.

The present invention also provides a method for improving the current carrying capacity of a pivot joint for a movable contact arm in a molded case circuit breaker. The circuit breaker has an operating mechanism coupled to a line terminal, a trip mechanism and a load terminal with the load terminal coupled to a pivot mounting member. The method comprises the steps of providing a recess in a first sidewall of the contact arm with the recess co-axial with the mounting hole in the contact arm. Providing a second recess in a second sidewall of the contact arm, with the second recess co-axial with the second mounting hole in the contact arm. The first and second recesses are co-axial with each other. Providing a pair of shaped washers and placing one of the shaped washers in each of the recesses. Providing a mounting axle and inserting the mounting axle into each mounting hole and engaging each shaped washer and the pivot mounting member. Then positioning a spring to engage both ends of the mounting axle and urging the contact arm against each shaped washer.

DETAILED DESCRIPTION OF THE PREFERRED EMBODIMENTS

Figure 1:
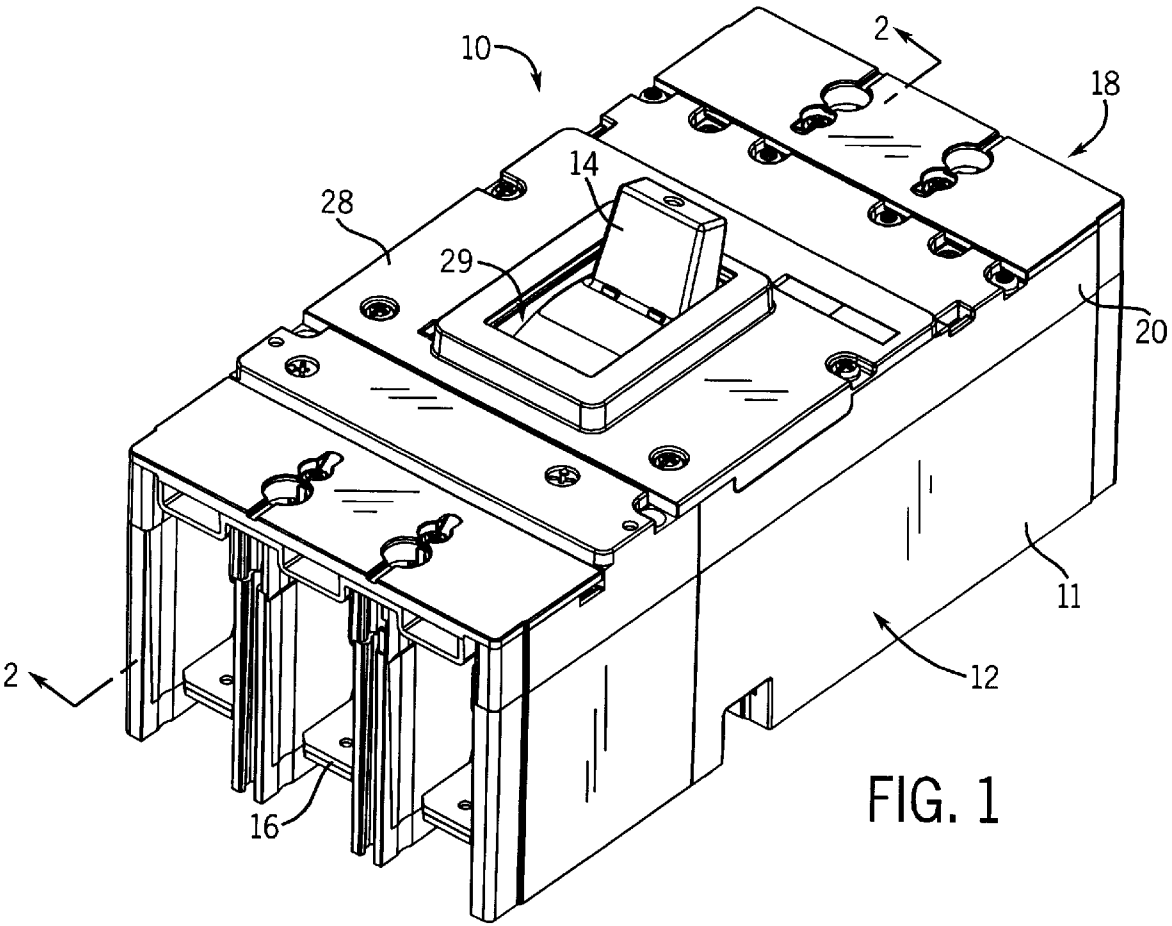
FIG. 1 is an isometric drawing of a molded case circuit breaker which includes an embodiment of the present pivot joint for a movable contact arm.

FIG. 1 generally illustrates a three phase molded case circuit breaker 10 of the type which includes an operating mechanism 40 having a pivoting member 13 with a handle 14. The pivoting member 13 and handle 14 are moveable between an ON position, an OFF position and a TRIPPED position.

The exemplary circuit breaker 10 is a three pole breaker having three sets of contacts for interrupting current in each of the three respective electrical transmission phases. In the exemplary embodiment of the invention, each phase includes separate breaker contacts and a separate trip mechanism. The center pole circuit breaker includes an operating mechanism which controls the switching of all three poles of the breaker. Although an embodiment of the present invention is described in the context of the three phase circuit breaker, it is contemplated that it may be practiced in a single phase circuit breaker or in other multi-phase circuit breakers.

Figure 2:
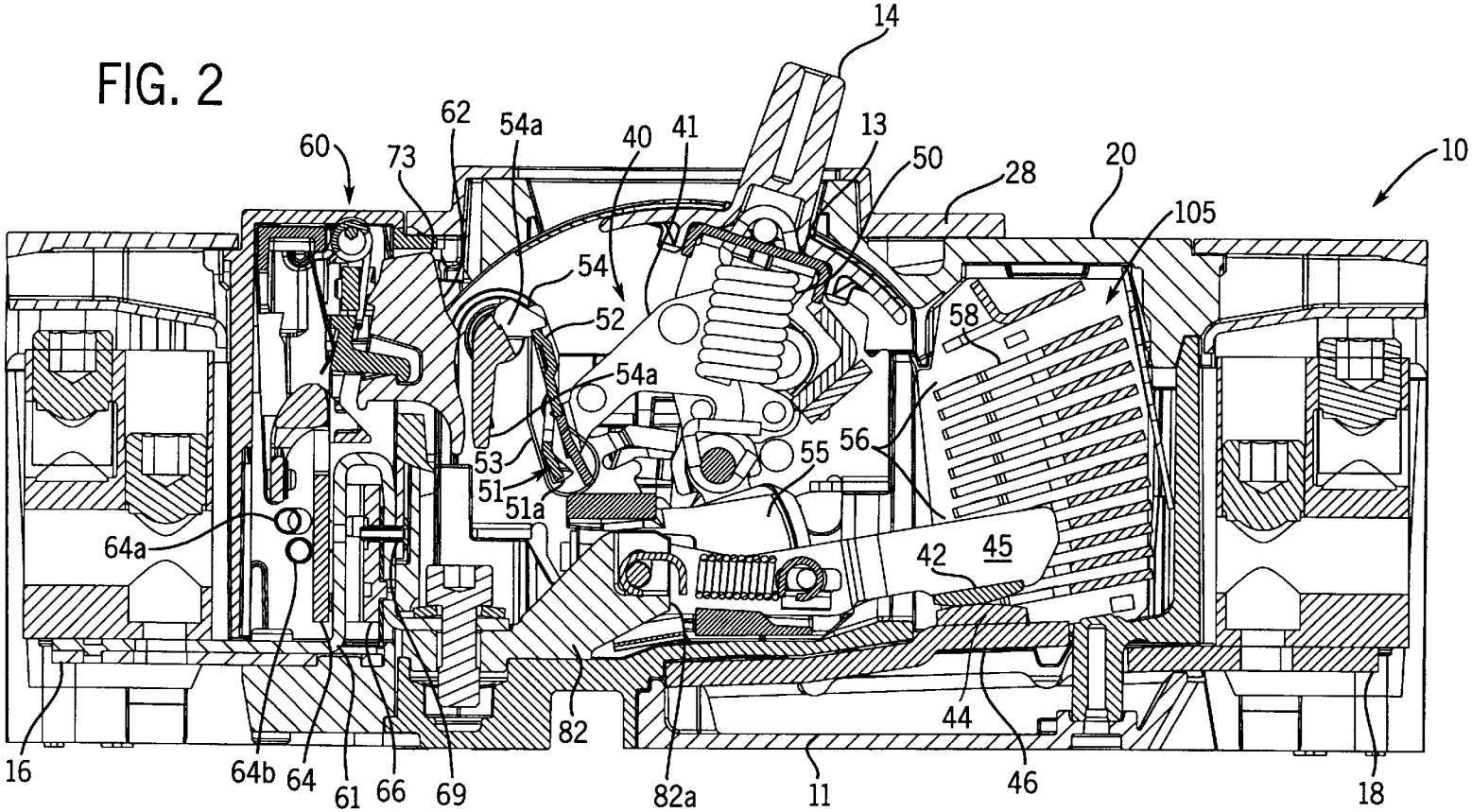
FIG. 2 is a section interior view of an exemplary embodiment of a circuit breaker having a trip unit housed in separate housing and coupled to the movable contact arm and used to describe the operation of the circuit breaker.

Referring to FIG. 2., handle 14 is operable between the ON and OFF positions to enable a contact operating mechanism 40 to engage and disengage a moveable contact 42 and a stationary contact 44 for each of the three phases, such that the line terminal 18 and load terminal 16 of each phase can be electrically connected through a terminal opening in the housing 12. The circuit breaker housing 12 includes three portions which are molded from an insulating material. These portions include a circuit breaker base 11, a circuit breaker cover 20 and an accessory cover 28 with breaker cover 20 and the accessory cover 28 having an opening 29 for the handle 14 of the pivoting member 13. The pivoting member 13 and handle 14 move within the opening 29 during the several operations of the circuit breaker 10. FIG. 2 is a sectional view of the circuit breaker 10 along the lines 2—2 shown in FIG. 1. As shown in FIG. 2, the main components of the circuit breaker are a fixed line contact arm 46 and a moveable load contact arm 45. It should be noted that another embodiment of the circuit breaker 10 has a movable line contact arm to facilitate a faster current interruption action. The load contact arms for each of the three phases of the exemplary breaker are mechanically connected together by an insulating cross bar member 55. This cross bar member 55, in turn, is mechanically coupled to the operating mechanism 40 so that, by moving the handle 14 from left to right, the cross bar 55 rotates in a clockwise direction and all three load contact arms 45 are concurrently moved to engage their corresponding line contact arms 46, thereby making electrical contact between moveable contact pad 42 and stationary contact pad 44.

The operating mechanism 40 includes a cradle 41 which engages an intermediate latch 52 to hold the contacts of the circuit breaker in a closed position unless and until an over current condition occurs, which causes the circuit breaker to trip. A portion of the moveable contact arm 45 and the stationary contact bus 46 are contained in an arc chamber 56. Each pole of the circuit breaker 10 is provided with an arc chamber 56 which is molded from an insulating material and is part of the circuit breaker 10 housing 12. A plurality of arc plates 58 are maintained in the arc chamber 56. The arc plates facilitate the extension and cooling of the arc formed when the circuit breaker 10 is opened while under a load and drawing current. The arc chamber 56 and arc plates 58 direct the arc away from the operating mechanism 40. The arc chamber 56 and arc plates 58 that make up an arc chute assembly 105 will be more fully described below.

The exemplary intermediate latch 52 is generally Z-shaped having an intermediate portion which includes a primary latch surface that engages the cradle 41 and an upper portion having a secondary latch surface which engages a trip bar 54. The lower portion of the Z-shaped intermediate latch element 52 is angled with respect to the upper and lower legs and includes two tabs which provide a pivot edge for the intermediate latch 52 when it is inserted into the mechanical frame 51. As shown in FIG. 2, the intermediate latch 52 is coupled to a spring 53 which is retained by the shape of the intermediate latch 52. The spring 53 biases the primary latch surface of the intermediate latch 52 toward the cradle 41 while at the same time biasing the trip bar 54 into a position which engages the secondary latch surface of the intermediate latch 52. The trip bar 54 pivots in a counter clockwise direction about an axis 54*a*, responsive to a force exerted by a trip actuator 62, during, for example, a long duration over current condition. As the trip bar 54 rotates, in a counter clockwise direction, the latch surface on the trip bar disengages the secondary latch surface on the upper portion of the intermediate latch 52. When this latch surface of the intermediate latch 52 is disengaged, the intermediate latch 52 rotates in a counter clockwise direction under the force of the operating mechanism 40, exerted through a cradle 41. In the exemplary circuit breaker, this force is provided by a tension spring 50. Tension is applied to the spring when the breaker toggle handle 14 is moved from the open position to the closed position. More than one tension spring 50 may be utilized.

As the intermediate latch 52 rotates responsive to the upward force exerted by the cradle 41, it releases the primary latch on the operating mechanism 40, allowing the cradle 41 to rotate in a clockwise direction. When the cradle 41 rotates, the operating mechanism 40 is released and the cross bar 55 rotates in a counter clockwise direction to move the load contact arms 45 away from the line contact arms 46.

In order to provide a broad range of current ratings, for various applications, a trip mechanism 60 includes several interchangeable parts as illustrated in FIG. 2. Typically, it is desirable to time the magnetic trip mechanism 60 so that it trips at lower short circuit currents at the lower continuous current ratings, and that it trips at higher short circuit currents at the higher continuous current ratings. For example, for a circuit breaker rated at 32 amps., a magnetic trip level of 300 amps. might be desired, whereas for a breaker rated at 125 amps. of continuous current, a magnetic trip level of 1,250 amps. might be desired. In order to accommodate the various ranges of current ratings, the trip mechanism 60 can be modified with a change of certain parts, easily and advantageously during manufacture of the breaker as the needs of the circuit to be protected change from time to time.

The trip mechanism 60 comprises a magnetic short circuit release and a thermal overload release. The magnetic short circuit release is a U-shaped, yoke 66 formed from a magnetically compatible material, such as steel. The yoke 66 is connected to a flat steel magnetic armature 64 which rotates on the armature retainer in response to the magnetic field generated by current flowing through the conductive path in the circuit breaker 10. The armature 64 is biased by springs 64*a* and 64*b*. The yoke 66 is coupled to the load bus 61 by rivets 69 or other suitable fasteners.

The bi-metal element 62 is coupled to the load bus 61. A calibration screw 68 threadingly mounted in the thermal adjustment bar 70 changes the distance between the bi-metal element 62 and thermal bar 70 and magnetic trip bar 71 combination. The thermal adjustment bar 70 and magnetic trip bar 71 are coaxially located on pivot pins 72. Thermal bar 70 is further coupled to magnetic trip bar 71 via a pin (not shown) on the thermal adjustment bar 70 which engages a ramped slot in the magnetic trip bar 71. The thermal adjustment bar 70 can be made to move axially with respect to the magnetic trip bar 71, wherein the pin on the thermal adjustment bar 70 moves along the ramp slot of the magnetic trip bar 71 causing the thermal adjustment bar 70 to rotate relative to the magnetic trip bar 71 on the common axis with the magnetic trip bar 71. This action increases or decreases the calibration screw gap providing common adjustment for all poles simultaneously. The bi-metal element 62 is a planar strip having a generally rectangular cross section. One end of the bi-metal element strip is coupled to the load bus 61 with the other end of the bi-metal element 62 free to move in response to heat transferred from the load bus 61.

Figure 4:
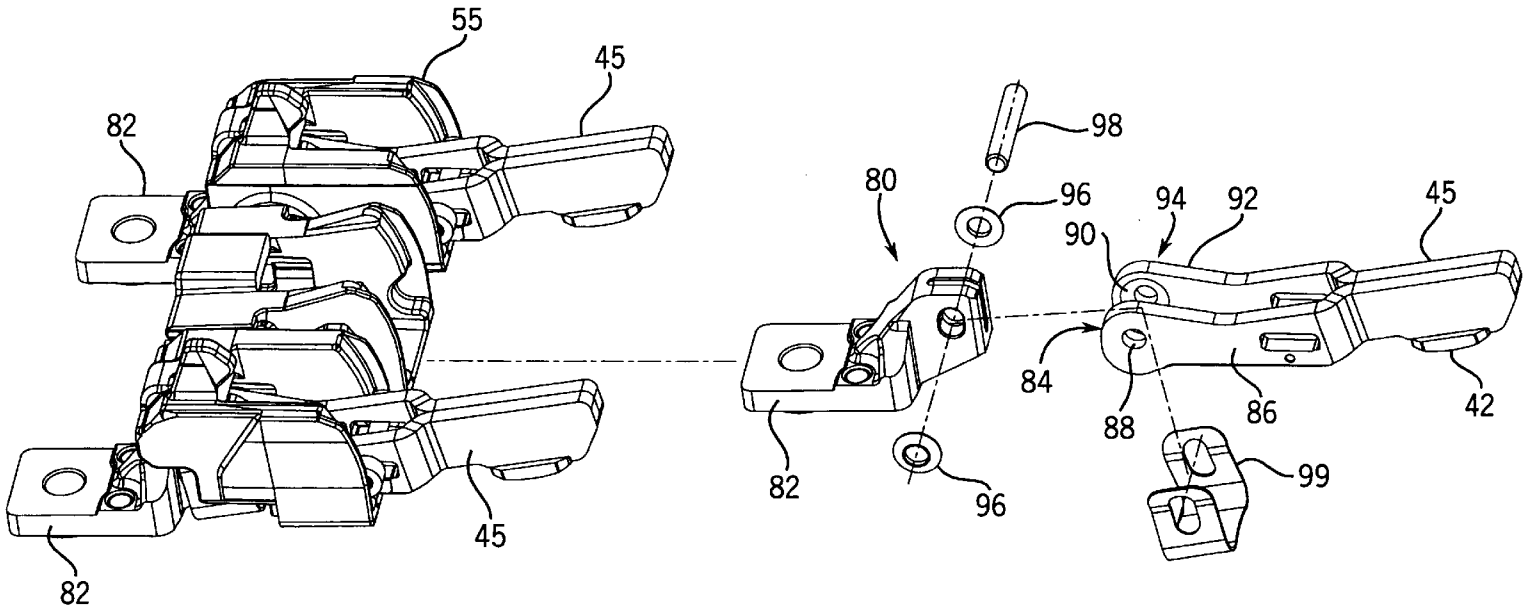
FIG. 4 is an exploded isometric drawing of an exemplary embodiment of a movable contact arm assembly having a pivot joint and the contact arm having at least two parts, including a pair of shaped washers.

FIG. 4 illustrates a pivot mounting member 82 having a bolt hole used to couple with the load bus 61. However, other suitable attachment means are contemplated herein. The trip mechanism 60 described above is mounted in the circuit breaker 10 housing 12 for each pole of the circuit breaker 10. Current flowing through the circuit breaker from the moveable contact arm 45 through pivot mounting member 82 into the load bus element 61, to the load terminal 16 heats the bi-metal strip 62 which causes it to deflect and engage the calibration screw of thermal bar 70, which in turn unlatches the latch 73, which strikes the arm 54*a* of latch bar 54 and unlatches the operating mechanism 40, as described above.

During normal operation of the circuit breaker, current flows from the line terminal 18 through the line contact arm 46 and its stationary contact pad 44 to the load contact arm 45 through its contact pad 42. From the load contact arm 45, the current flows through a pivot joint 82*a* to the load bus 61 and then to the load terminal 16. When the current flowing through the circuit breaker exceeds the rated current for the breaker, it heats the load bus 61 which transfers heat to the bi-metalic element 62, causing the element 62 to bend towards the trip bar combination 70, 71. If the over current condition persists, the bi-metalic element 62 bends sufficiently to engage the trip bar calibration screw 68. As the bi-metalic element engages the trip bar surface and continues to bend, it causes the trip bar combination 70, 71 to rotate in a counter clockwise direction releasing the trip unit latch 73, in turn causing trip bar 54 to rotate and thus unlatching the operating mechanism 40 of the circuit breaker.

Figure 3:
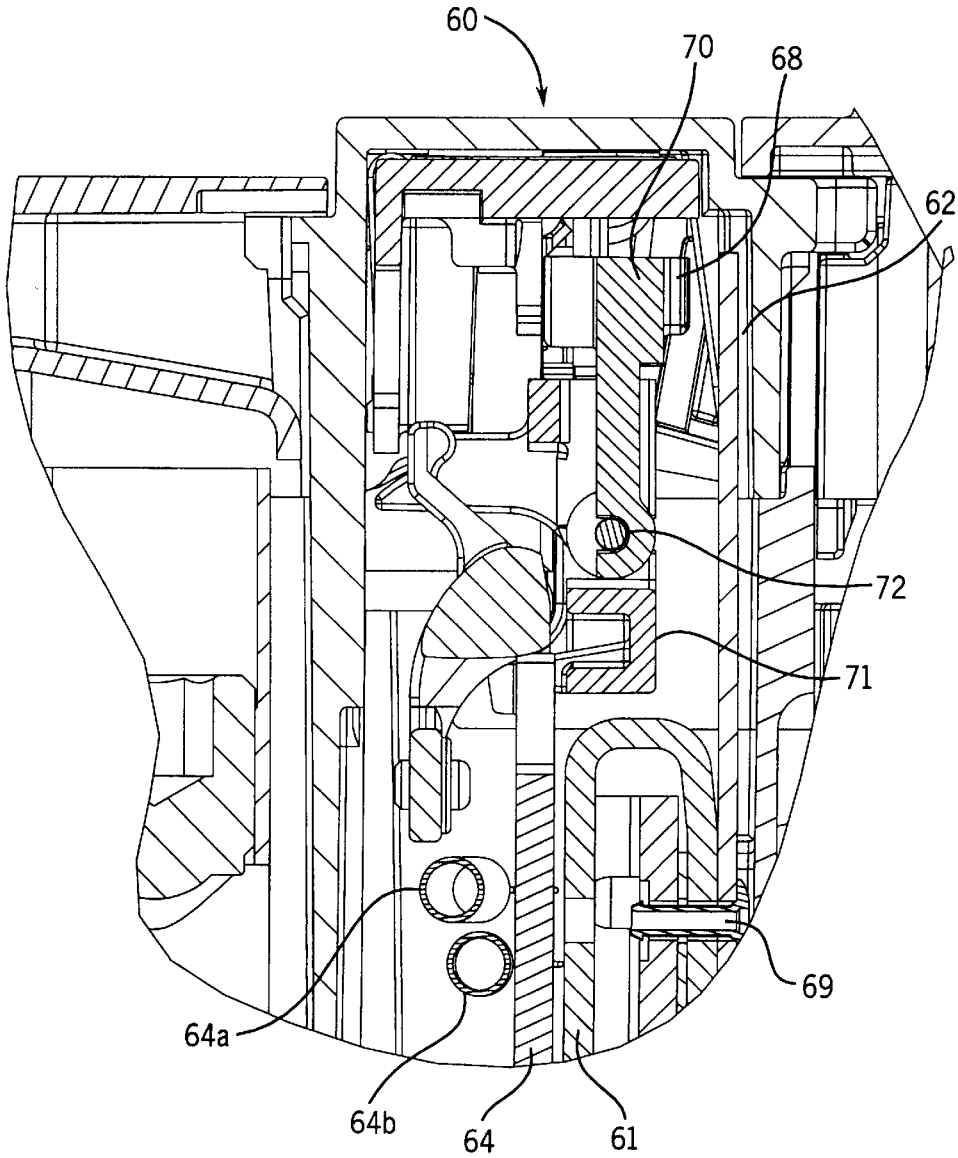
FIG. 3 is a partial section interior view of the trip unit in the circuit breaker illustrated in FIG. 2.

FIG. 3 is an exploded isometric drawing which illustrates an exemplary embodiment of construction of a portion of the circuit breaker shown in FIG. 2. In FIG. 3 only an exemplary embodiment of the load contact arm 45 of the center pole of the circuit breaker is shown. This load contact arm 45 as well as the contact arms for the other two poles, are fixed in position in the cross bar element 55. As mentioned above, additional poles, such as a four pole molded case circuit breaker can utilize the same construction as described herein, with the fourth pole allocated to a neutral. The load contact arm 45 is coupled to the load bus 61 through a pivot joint 80 comprised of a contact arm 45 (which can be one or more pieces), shaped washer 96, mounting axle 98, pivot terminal 82, and a spring 99. The pivot joint 80 is more fully described below. As shown in FIG. 3, current flows from the contact arm 45, through the shaped washers 96 to the pivot terminal 82, then through the bolted connection to the load bus 61.

In the exemplary circuit breaker 10, the cross bar 55 is coupled to the operating mechanism 40, which is held in place in the base or housing 12 of the molded case circuit breaker 10 by a mechanical frame 51. The key element of the operating mechanism 40 is the cradle 41. As shown in FIG. 3, the cradle 41 includes a latch surface 41*a* which engages the lower latch surface in the intermediate latch 52. The intermediate latch 52 is held in place by its mounting tabs which extend through the respective openings 51*a* on either side of the mechanical frame 51. In the exemplary embodiment of the circuit breaker, the two side members of the mechanical frame 51 support the operating mechanism 40 of the circuit breaker 10 and retain the operating mechanism 40 in the base 12 of the circuit breaker 10.

A movable load contact arm 45 is part of a movable contact arm assembly as shown in FIGS. 2, 3 and 4. FIGS. 3 & 4 depict the movable contact arm 45 as being composed of at least two parts, a left and a right side which are bonded together by, for example, brazing or welding. It should be understood that the movable contact arm 45 can be a single piece and molded, formed or machined as is appropriate for the particular application and current carrying capabilities of the circuit breaker 10. During the manufacturing process, the various mating portions of the contact arm assembly may be misaligned due to variances and tolerance differentials, which cause point contact between the various mating portions. These point contacts are undesirable since they allow heat to build up at the point contacts because of current density. To address such tolerance variances, a pivot joint 80 for a movable contact arm assembly in a circuit breaker is provided.

As discussed above, the circuit breaker has an operating mechanism 40 coupled to a line terminal 18, a trip mechanism 60 and a load terminal 16, with the load terminal 16 coupled to a pivot mounting member 82. The pivot joint comprises a recess 84 in a first sidewall 86 of the contact arm 45 with the recess 84 co-axial with a mounting hole 88 (also known as a pivot hole) in the contact arm 45. A second recess 90 in a second sidewall 92 of the contact arm 45 also has the second recess 90 co-axial with the second mounting hole 94 in the contact arm 45 wherein the first and second recesses 84, 90 are co-axial with each other. (See FIG. 4). A shaped washer 96 configured to fit in each of the first and second recesses, 84, 90 are inserted in each of the respective recesses. A mounting axle 98 configured to engage each shaped washer 96, each mounting hole 88, 94 and the pivot mounting member 82 is installed. A contact arm 45 is free to pivot about the mounting axle 98 during the operation of the circuit breaker 10. A spring 99 is configured to engage both ends of the mounting axle 98 and urge the contact arm 45 against each shaped washer 96.

Another embodiment of the pivot joint 80 provides that the two recesses 84, 90 are in a facing relationship with each other as shown in FIG. 4. It is also contemplated that the contact arm 45 can be configured to be inserted between two opposing tangs of the pivot mounting member 82 rather than straddling the pivot mounting member 82 as shown in FIG. 4. In any case, the shaped washers 96 are inserted into recesses 84, 90 to act as bearings and minimize or eliminate point contact because of dimensional discrepancies in the various mating parts. The shaped washers 96 provide a more uniform current path for the electric current passing through the contact arm 45 through the pivot joint 80 to the pivot mounting member 82 and onto the trip mechanism 60 as described earlier in this specification.

The shaped washer 96 can be spherical with the recess 84, 90 having a corresponding conical shape to receive the shaped washer 96. It is also contemplated that other shapes can be utilized, for example, a conical or truncated cone shape for the washer 96, again with a different corresponding recess 84, 90 shape to receive such washer 96. The different shaped washer and recess allow self-alignment of the contact arm 45 and mounting member 82.

Although the shaped washer 96 can be of a metallic material different from the material used in the contact arm 45 and the pivot mounting member 82 it is contemplated that all these components would be composed of the same material, such as, for example, copper or a silver tinted alloy.

Figure 5:
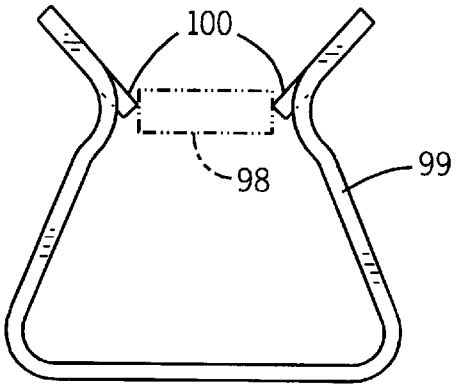
FIG. 5 is an end plan view of an exemplary embodiment of a spring used to engage a mounting axle of the pivot joint and with the spacing having a lance in each leg of the spring's U-shape.

In another embodiment of the pivot joint 80, the spring 99 includes a lance 100 in each of the U-shaped arms of the spring with the lance configured to align with the mounting axle 98 to maintain the mounting axle 98 in each of the mounting holes 88, 94. The axle 98 can also be held in place, avoid lateral movement, by the walls of the crossbar 55. FIG. 5 illustrates an exemplary embodiment of the spring 99 having a lance 100 in each of its U-shaped legs and engaging an end of a mounting axle 98 which is depicted in dotted lines. It is also contemplated that other means for maintaining the mounting axle 98 in the mounting holes 88, 94 can be utilized such as, for example, a friction washer or a deforming detent in each end of the mounting axle 98.

The pivot joint 80 also provides a method for improving the current carrying capacity of the pivot joint for a movable contact arm 45 in a molded case circuit breaker 10 with the circuit breaker 10 having an operating mechanism 40 coupled to a line terminal 18, a trip mechanism 60 and a load terminal 16, with the load terminal 16 coupled to a pivot mounting member 82. The method comprises the steps of providing a recess 84 in a first sidewall 86 of the contact arm 45 with the recess 84 co-axial with a mounting hole 88 in the contact arm 45. Also providing a second recess 90 in a second sidewall 92 of the contact arm 45 with the second recess 88 being co-axial with a second mounting hole 94 in the contact arm 45, wherein the first and second recesses 84, 90 are co-axial with each other. Then providing a pair of shaped washers 96 and placing one of the shaped washers 96 in each recess 84, 90. Then providing a mounting axle and inserting the mounting axle 98 into each mounting hole 88, 94 and engaging each shaped washer 96 and the pivot mounting member 82. Then positioning a spring 99 to engage both ends of the mounting axle 98 and urging the contact arm 45 against each shaped washer 96 to create the pivot joint 80. In such configuration, the contact arm 45 is free to pivot about the pivot joint 80 on the mounting axle 98 with the shaped washers minimizing or eliminating any point contacts between the several parts and distributing the current carrying capacity through a larger area of the pivot joint 80. The spring 99 can also be provided with a lance 100 in each of its U-shaped legs which can be used to retain the mounting axle 98 in position in the pivot joint 80.

While the embodiments illustrated in the Figures and described above are presently preferred, it should be understood that these embodiments are offered by way of example only. The invention is not intended to be limited to any particular embodiment, but it is intended to extend to various modifications that nevertheless fall within the scope of the intended claims. For example, different shapes can be utilized for the arc plates. It is also contemplated that an electronic trip unit can be utilized. It is further contemplated that the trip mechanism having a bi-metal or electronic trip unit and load terminal be housed in a separate housing capable of mechanically and electrically connecting to another housing containing the operating mechanism, movable contact arm, pivot joint and line terminal thereby providing for a quick and easy change of current ratings for an application of the circuit breaker contemplated herein. Other modifications will be evident of those with ordinary skill in the art.

What is claimed is:

1. A pivot joint for a movable contact arm assembly in a circuit breaker having an operating mechanism coupled to a line terminal, a trip mechanism and a load terminal with the load terminal coupled to a pivot mounting member, the pivot joint comprising:

a recess in a first sidewall of the contact arm, with the recess co-axial with a mounting hole in the contact arm;

a second recess in a second sidewall of the contact arm, with the second recess co-axial with a second mounting hole in the contact arm, wherein the first and second recesses are co-axial with each other;

a shaped washer, configured to fit in each of the first and second recesses;

a mounting axle configured to engage each shaped washer, each mounting hole and the pivot mounting member, wherein the contact arm is free to pivot about the mounting axle; and, a spring, with the spring configured to engage both ends of the mounting axle and urge the contact arm against each shaped washer.

2. The pivot joint of claim 1, wherein the two recesses are in a facing relationship with each other.

3. The pivot joint of claim 1, wherein each shaped washer is spherical and each recess is conical in configuration.

4. The pivot joint of claim 3, wherein each shaped washer is composed of the same material as the contact arm.

5. The pivot joint of claim 4, wherein the spring includes a lance configured to align with the mounting axle to maintain the mounting axle in each of the mounting hole.

6. A molded case circuit breaker comprising:

a molded housing including a breaker cover;

a first terminal and a second terminal mounted in the housing;

a contact electrically coupled to the first terminal;

an operating mechanism having a pivoting member moveable between an "ON" position, an "OFF" position and a "TRIPPED" position;

an intermediate latching mechanism mounted in the housing and coupled to the operating mechanism;

a trip mechanism selectively coupled to the operating mechanism and electrically connected to the second terminal;

a moving contact arm and assembly including a pivot mounting member coupled to the second terminal and the pivoting member of the operating mechanism; and, a pivot joint for the moving contact arm, the pivot joint comprising:

a recess in a first sidewall of the contact arm, with the recess co-axial with a mounting hole in the contact arm;

a second recess in a second sidewall of the contact arm, with the second recess co-axial with a second mounting hole in the contact arm, wherein the first and second recesses are co-axial with each other;

a shaped washer, configured to fit in each of the first and second recesses;

a mounting axle configured to engage each shaped washer, mounting hole and the pivot mounting member, wherein the contact arm is free to pivot about the mounting axle; and, a spring, with the spring configured to engage both ends of the mounting axle and urge the contact arm against each shaped washer.

7. The circuit breaker of claim 5, wherein the two recesses are in a facing relationship with each other.

8. The circuit breaker of claim 5, wherein each shaped washer is spherical and each recess is conical in configuration.

9. The circuit breaker of claim 7, wherein each shaped washer is composed of the same material as the contact arm.

10. The circuit breaker of claim 9, wherein the spring includes a lance configured to align with the mounting axle to maintain the mounting axle in each of the mounting holes.

11. A circuit breaker comprising:

a housing including a base;

a means for connecting a load to the breaker, mounted in the housing;

a means for connecting an electrical line to the breaker, mounted in the housing;

a stationary contact electrically coupled to the means for connecting an electrical line;

a means for moving a contact arm coupled to a means for operating mounted in the housing and having a pivoting member moveable between an "ON" position and "OFF" position, and a "TRIPPED" position, with the pivoting member coupled to the means for moving a contact arm and with the means for operating coupled to an intermediate means for latching the means for operating;

a means for tripping coupled to the means for moving a contact arm and the means for connecting a load with the means for tripping in selective operative contact with the intermediate means for latching and the means for connecting a load coupled to a means for mounting the contact arm; and, a means for pivoting the contact arm, the means for pivoting the contact arm comprising:

a means for recessing in a first sidewall of the contact arm, with the means for recessing co-axial with a mounting hole in the contact arm;

a second means for recessing in a second sidewall of the contact arm, with the second means for recessing co-axial with a second mounting hole in the contact arm, wherein the first and second means for recessing are co-axial with each other;

a means for reducing binding configured to fit in each of the first and second means for recessing;

a mounting axle configured to engage each means for reducing binding, each mounting hole and the means for mounting the contact arm, wherein the contact arm is free to pivot about the mounting axle; and, a means for biasing, with the means for biasing configured to engage both ends of the mounting axle and urge the contact arm against each means for reducing binding.

12. The circuit breaker of claim 9, wherein the two means for recessing are in a facing relationship with each other.

13. The circuit breaker of claim 9, wherein each means for reducing binding is spherical and each means for recessing is conical in configuration.

14. The circuit breaker of claim 11, wherein each means for reducing binding is composed of the same material as the contact arm.

15. The circuit breaker of claim 14, wherein the means for biasing includes a means for maintaining configured to align with the mounting axle to maintain the mounting axle in each of the mounting holes.

16. A method for improving the current carrying capacity of a pivot joint for a movable contact arm in a molded case circuit breaker, with the circuit breaker having an operating mechanism coupled to a line terminal, a trip mechanism and a load terminal, with the load terminal coupled to a pivot mounting member, the method comprising the steps of:

providing a recess in a first sidewall of the contact arm, with the recess co-axial with a mounting hole in the contact arm;

providing a second recess in a second sidewall of the contact arm, with the second recess co-axial with a second mounting hole in the contact arm, wherein the first and second recesses are co-axial with each other;

providing a pair of shaped washers;

placing one of the shaped washers in each recess;

providing a mounting axle;

inserting the mounting axle into each mounting hole and engaging each shaped washer and the pivot mounting member; and, positioning a spring to engage both ends of the mounting axle and urging the contact arm against each shaped washer.

17. The method of claim 13, wherein the two recesses are in a facing relationship with each other.

18. The method of claim 13, wherein each shaped washer is spherical.

19. The method of claim 15, wherein each shaped washer is composed of the same material as the contact arm.

20. The method of claim 19, including the step of providing a spring with a lance configured to align with the mounting axle to maintain the mounting axle in each of the mounting holes.

* * * * *